United States Patent [19]

Ventura et al.

[11] Patent Number: 4,884,388

[45] Date of Patent: Dec. 5, 1989

[54] LETTUCE PACKER

[75] Inventors: Leon P. Ventura, Watsonville; Javier Diaz-Infante, Salinas, both of Calif.

[73] Assignee: Bud of California, Salinas, Calif.

[21] Appl. No.: 159,798

[22] Filed: Feb. 24, 1988

[51] Int. Cl.[4] ..... B65B 39/02; B65B 5/08; B65B 5/10; B65B 67/00

[52] U.S. Cl. ..... 53/537; 53/539; 53/247; 53/255; 53/258; 53/261; 53/262; 53/390; 294/172

[58] Field of Search ..... 53/248, 260, 261, 262, 53/263, 391, 443, 446, 448, 537, 538, 539, 543, 247, 390; 220/21; 294/172

[56] References Cited

U.S. PATENT DOCUMENTS

| | | | |
|---|---|---|---|
| 133,173 | 11/1872 | Penick | 53/263 |
| 2,804,739 | 9/1957 | Martin | 53/391 |
| 2,957,286 | 10/1960 | Heller | 53/446 X |
| 3,057,136 | 10/1962 | Walter | 53/262 |
| 3,338,009 | 8/1967 | Stevens | 53/248 X |
| 3,386,224 | 6/1968 | Shuttleworth | 53/538 |
| 3,590,994 | 7/1971 | Goudreau | 53/248 X |
| 3,672,117 | 5/1972 | Shuttleworth et al. | 53/248 X |
| 3,984,964 | 10/1976 | Stoll | 53/543 |
| 4,435,941 | 3/1984 | Booth et al. | 53/538 X |
| 4,726,167 | 2/1988 | Hartness | 53/262 X |

*Primary Examiner*—Horace M. Culver

*Assistant Examiner*—Ann Tran

*Attorney, Agent, or Firm*—Townsend and Townsend

[57] ABSTRACT

A lettuce packing machine for the packing of heads of lettuce in corrugated, cardboard cartons is disclosed. A lettuce head holding tray is loaded with lettuce. Thereafter, the tray is utilized to pack cartons. The lettuce head holding trays has discrete lettuce receiving cells upwardly exposed. Each tray contains four columns of cells, each column of cells being three wide for a capacity of 12 heads of lettuce. Each discrete lettuce receiving cell in the tray is defined by four semirigid, flexible sides, which sides extend downwardly and inwardly, are elastically biased and form an inverted pyramid-like profile truncated at an open bottom. The lettuce head holding tray is loaded at a picking station and conveyed to a packing station. When the lettuce head holding tray arrives at the packing station, a packing apparatus having discrete plungers—one for each cell—unloads the tray overlying a box to be packed. A first loaded lettuce holding tray with lettuce stems downwardly placed packs the lower layer of a box. A second lettuce holding tray with the lettuce stems exposed to the side corner of the cells packs the upper layer of a box. In each case, the lettuce of each layer moves as a mass into the lettuce box with no relative movement between the discrete side by side lettuce heads of a single layer.

7 Claims, 6 Drawing Sheets

LETTUCE PACKER

BACKGROUND OF THE INVENTION

This invention relates to the packing of fresh produce and more particularly to a process and apparatus which is designed for the specialized problems in packing heads of lettuce into cartons for shipment and vending.

SUMMARY OF THE PRIOR ART

The bulk of lettuce requires shipping and distribution in corrugated containers. Unfortunately, and because of its delicate nature, lettuce—particularly iceberg lettuce—presents a relatively difficult packing problem.

Iceberg lettuce is typically packed into cartons in the fields. In one method—known as the flat pack method—heads of lettuce are severed and left inverted in the field by pickers. Packers come along and place the lettuce by rows of three in boxes. Four rows of three heads of lettuce each are placed in a layer in a box. A box typically has two layers and therefore holds 24 heads of lettuce.

Heads of iceberg lettuce when placed in cartons are frequently damaged. The heads of lettuce are typically placed in the box by the packer with three side-by-side heads being placed at one time. Typically, the packer holds a first head of lettuce in the left hand, a second head of lettuce in the right hand and braces a third head of lettuce in between the two held heads. All three heads of lettuce so held are then placed within a carton in one three wide row at a time.

For the initial three heads placed within an empty carton, damage is minimal. However, as successive rows of three are placed within the carton being packed, damage occurs to the heads of lettuce. Specifically, the heads of lettuce abrade each other upon entering the carton. That is to say, the heads of lettuce already packed and placed in a box rub against and abrade the lettuce being placed subsequently in the box. This abrasion is most aggravated when the stem portion of one head of lettuce compresses and scrapes along the leaf portion of an adjacent, previously placed, head of lettuce.

Placement of the final row of three in any individual layer of a carton cumulates the difficulties of hand packing. Moreover, the last row of three requires a force fit or stuffing of the last row of lettuce into the carton. The sides of the carton into which the lettuce is placed can be seen to slightly bulge.

The packing of the last row of the top lettuce layer presents a difficulty in packing of the box that is not present when the bottom row is packed. Specifically, the top layer of lettuce is usually only partially inserted by the packer into the box. Thereafter, the box is lifted high in the air and dropped abruptly onto the ground. This dropping onto the ground causes the top layer of lettuce to move downwardly on top of the bottom layer of lettuce.

When this throwing motion occurs, the partially inserted top layer moves into complete contact with the previously inserted bottom layer. However, jarring and abrading and further resultant damage to the packed lettuce occurs.

Damage at the time of packing is primarily latent. Damaged heads of iceberg lettuce typically have a dark green tinge with a visible disruption to the high water content of the lettuce leaf.

At the time of packing this dark green tinge with its visible disruption is local to the point of damage. Other areas of the head of lettuce are unaffected by the local area of damage. For the most part, damage at the time of packing is hard to detect by those inexperienced with the packing of lettuce.

After packing, the cartons of lettuce are taken to a vacuum cooler, cooled, and shipped—frequently to destinations that are thousands of miles away. It is not uncommon for periods of up to one week to pass before the lettuce cartons are opened. And when the lettuce cartons are opened, then and only then is the real damage that occurred during packing apparent on the heads of lettuce.

Opening of the cartons typically occurs at the grocery department of a market. At that time, damage to the individual heads of lettuce which occurred during packing can be immediately seen. Specifically the damaged leaves of lettuce turn a molded and watery brown. This discoloration is no longer local to the point of damage on the head of lettuce. It spreads from the point of damage to the underlying layers of leaves. This mold or rot on the lettuce head spreads not only in the same head of lettuce but also passes between individual leaves on adjacent heads of lettuce.

The damage caused during packing may render the head unmarketable. The leaves subject to the mold or rot must be removed from the heads of lettuce before they can be placed on display for sale. Naturally the greater number of leaves required to be removed from a head of lettuce before sale, the less lettuce remains to be sold. The value of the shipped lettuce therefore declines.

It should be understood that frequently one badly spoiled head of lettuce will cause extensive damage to remaining heads of lettuce in the same carton. It is known that sometimes whole cartons of lettuce are spoiled.

Simply stated, any precaution that can be taken to prevent damage to carton packed lettuce should, in fact, be taken.

SUMMARY OF THE INVENTION

A lettuce packing machine for the packing of heads of lettuce in corrugated, cardboard cartons is disclosed. A lettuce head holding tray is loaded with lettuce. Thereafter, the tray is utilized to pack cartons. The lettuce head holding tray has discrete lettuce receiving cells upwardly exposed. Each tray contains four columns of cells, each column of cells being three wide for a capacity of 12 heads of lettuce. Each discrete lettuce receiving cell in the tray is defined by four semirigid, flexible sides, which sides extend downwardly and inwardly, are elastically biased and form an inverted pyramid-like profile truncated at an open bottom. The lettuce head holding tray is loaded at a picking station and conveyed to a packing station. When the lettuce head holding tray arrives at the packing station, a packing apparatus having discrete plungers—one for each cell—unloads the tray overlying a box to be packed. A first loaded lettuce holding tray with lettuce stems downwardly placed packs the lower layer of a box. A second lettuce holding tray with the lettuce stems exposed to the side corner of the cells packs the upper layer of a box. In each case, the lettuce of each layer moves as a mass into the lettuce box with no relative movement between the discrete side by side lettuce heads of a single layer.

OTHER OBJECTS, FEATURES AND ADVANTAGES

An object of this invention is to disclose an apparatus and process for packing lettuce a layer at a time into preferably two layer cartons. Accordingly, a lettuce head holding tray is loaded by a picker. The tray transports the picked heads of lettuce to an automated packing apparatus. The automated packing apparatus unloads the trays by pushing transported heads of lettuce through the bottom of the tray. The heads of lettuce are unloaded to a carton. As each carton preferably contains 24 discrete heads of lettuce, unloading of two successive trays loads a single carton for cooling and shipping to market.

A further object of this invention is to disclose a field transport tray for receiving heads of lettuce from a picker and transporting the heads of lettuce to the packing apparatus. The tray includes a base and a lattice shaped framework. The lattice shaped framework defines rows and columns of discrete lettuce holding cells. Preferably there are four columns of cells, each column having three cells. The sides of each cell is defined by depending semirigid flexible members. The depending semirigid flexible members are attached to the lattice shaped framework at the top and depend downwardly and inwardly so that the cross-sectional area of the cell decreases from the cell top to and towards the cell bottom. Consequently it is possible to load the cell with lettuce by placing an individual head in an individual cell and allowing the head to fall within the cell until the dimension of the cell sides stops the fall of the head. Further it is possible to unload the tray by pushing the heads of lettuce from the top of the tray towards and out the bottom of the tray.

An advantage of the disclosed tray is that it can serve as a conveying container. The tray is capable of being conveyed to the vicinity of a picker. The picker can load the tray. Thereafter, the loaded tray can be conveyed to a packing station with the contained heads of lettuce.

A further advantage of the tray is that a loaded tray can be unloaded into a lettuce box. Specifically, the heads of lettuce are simultaneously pushed into a side-by-side relation through the bottom of the tray. The tray during such pushing movements brings the adjacent heads of lettuce together. At the same time, relative movement between the adjacent heads is held to a minimum. The lettuce is moved together as a layered mass into a container.

A further object of this invention is to disclose a plunger for removing heads of lettuce from the cells. According to this aspect of the invention, a discrete plunger is given a dimension less than the plan section of the cell. The plunger has a concave bottom which concave bottom roughly conforms to the overall spherical shape of the head of lettuce. Typically, the plunger contacts the lettuce head and then moves through the lettuce cell. In such movement, the head of lettuce is prevented from rotating. Consequently, when a head of lettuce moves simultaneously with adjacent heads of lettuce, there is no relative movement between the lettuce heads and thus there is no abrasion.

A further object of this invention is to disclose a packing machine for unloading such tray cells. According to this aspect of invention, the machine includes a plurality of such plungers, one plunger for each cell of a tray. The plungers move in their packing motion together. The plungers move from a position overlying the cells into a position of contact with the heads of lettuce in the cells. Thereafter, the plungers move through the cells clearing the heads of lettuce before them. The heads of lettuce are moved simultaneously into the box to be loaded.

An advantage of the disclosed machine is that all adjacent heads of lettuce move together. The heads of lettuce are confined to slide along the smooth cell sides and confined to slide along the smooth carton sides until they are firmly packed.

A further advantage of the disclosed packing is that packing strokes can be varied. Specifically, a long packing stroke can be utilized for packing the lower layer of a carton. Similarly, a short packing stroke can be utilized for packing the upper layer of a carton. Further, the force of the strokes can be varied. Preferably, the force of the short stroke can be reduced so that the sensitive task of packing the upper carton layer of lettuce is done with minimal impact upon the lower carton layer of lettuce.

Yet another advantage to the disclosed packing machine is that it readily lends itself to required assembly line automation in the field. Empty cartons can be conveyed under the packing apparatus. Full cartons can be conveyed away as packed from the packing station, sealed and palletized.

An additional advantage of this invention is that the labor intensive picking and carton packing process of the prior art is simplified. Required packing personnel for packing the cartons in the field are reduced.

A further and unexpected result is that the machine packed cartons have an appearance which "looks" like but in fact is superior to, hand packed cartons. Upon opening of such a machine packed carton, those skilled in lettuce marketing can plainly see a difference in the side-by-side pack of the lettuce. Individual lettuce leaves on all heads of lettuce present in the box are uniformly disposed. Adjacent heads of lettuce occupy regular adjacent positions. Uniformity of pack is apparent to an extent that cannot be duplicated with hand packing procedures now known.

BRIEF DESCRIPTION OF THE DRAWINGS

Other objects, features, and advantages of this invention will be more apparent after referring to the following specifications and attached drawings in which:

Referring to FIG. 1 a tractor (not shown) pulling a trailer A supported on wheels W through a field planted conventionally with lettuce L in rows, The packing apparatus P rests on the trailer A. A conveyor assembly C shown extends to one side of trailer A.

Figure 1:
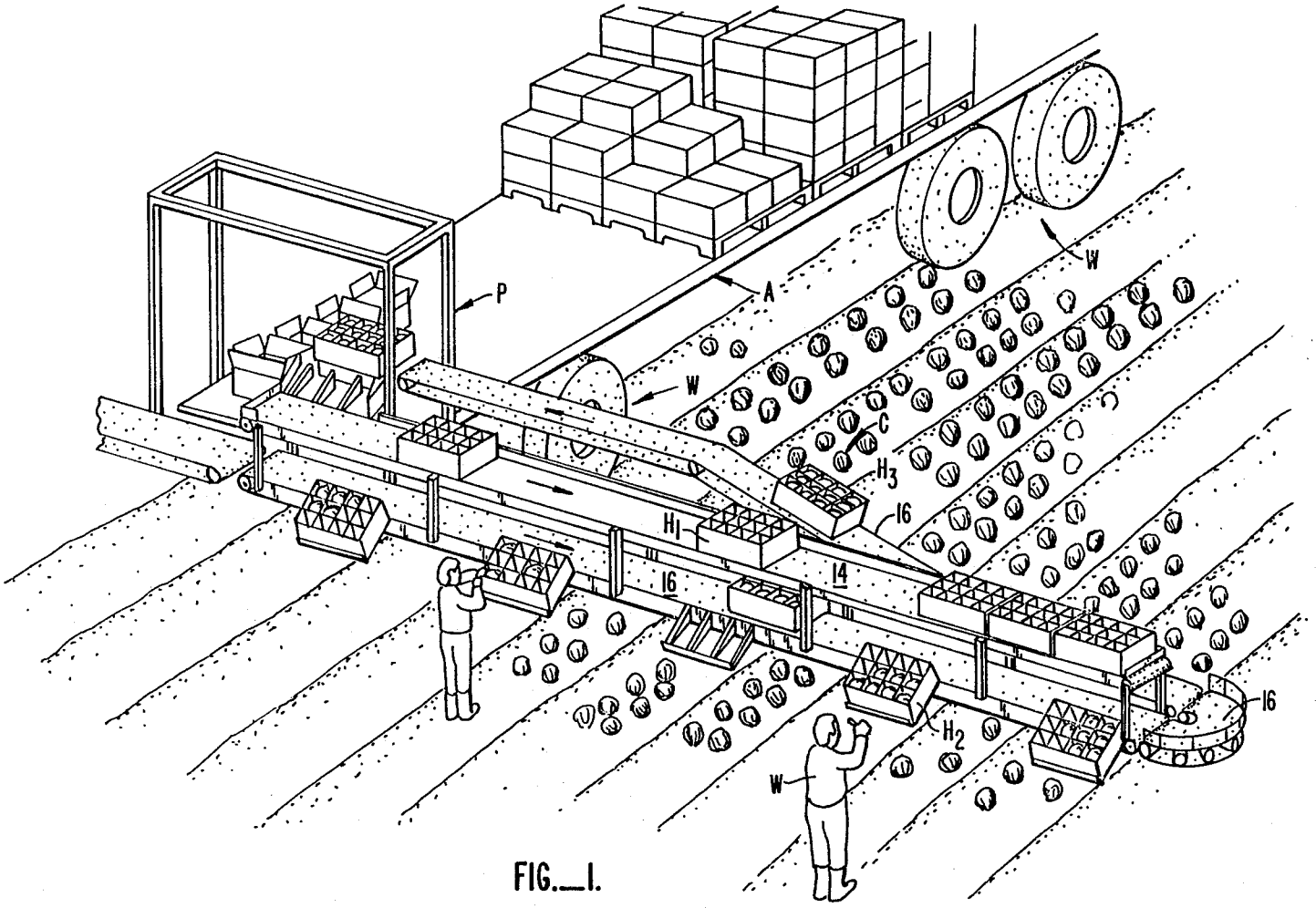
FIG. 1 is a perspective view of a packer conveying apparatus traversing a lettuce field utilizing the disclosed lettuce head holding trays for loading by a picker and conveying the holding trays to the packing apparatus and illustrating, in particular, the loading and palletizing of packed cartons of lettuce.

Packing apparatus is only partially shown in FIG. 1. This partial display is so that the reader may understand the illustrative layout of the conveyors used with this packing apparatus.

Conveyor assembly C includes a first and lower return tray conveyor 14 and a second and upper packing tray conveyor 16. The lettuce head holding trays H move to and from a worker W, only one worker W being shown for ease of understanding. Simply stated, tray H1 moves towards the worker W in an empty state. Tray H2 is moved from the lower conveyor 14 onto a slanted packing platform 20. Lettuce is loaded within each of the 12 cells of the tray. Thereafter, the tray is moved in the loaded disposition as illustrated in tray H3 and conveyed to and towards the packing apparatus P.

It will be understood that in the apparatus here illustrated, the length of the illustrated conveyor as well as the configuration of the conveyor can be varied. Further, the reader will realize that many workers W are spaced at numerous platforms along the length of the conveyor.

What follows will include first a detailed description of the lettuce head holding trays H. Thereafter, the loading of lettuce within such trays will be set forth. Finally, the use of the packing apparatus in moving the heads of lettuce from a layer in a tray into the carton to be packed will be set forth.

LETTUCE HEAD HOLDING TRAY

Figure 2A:
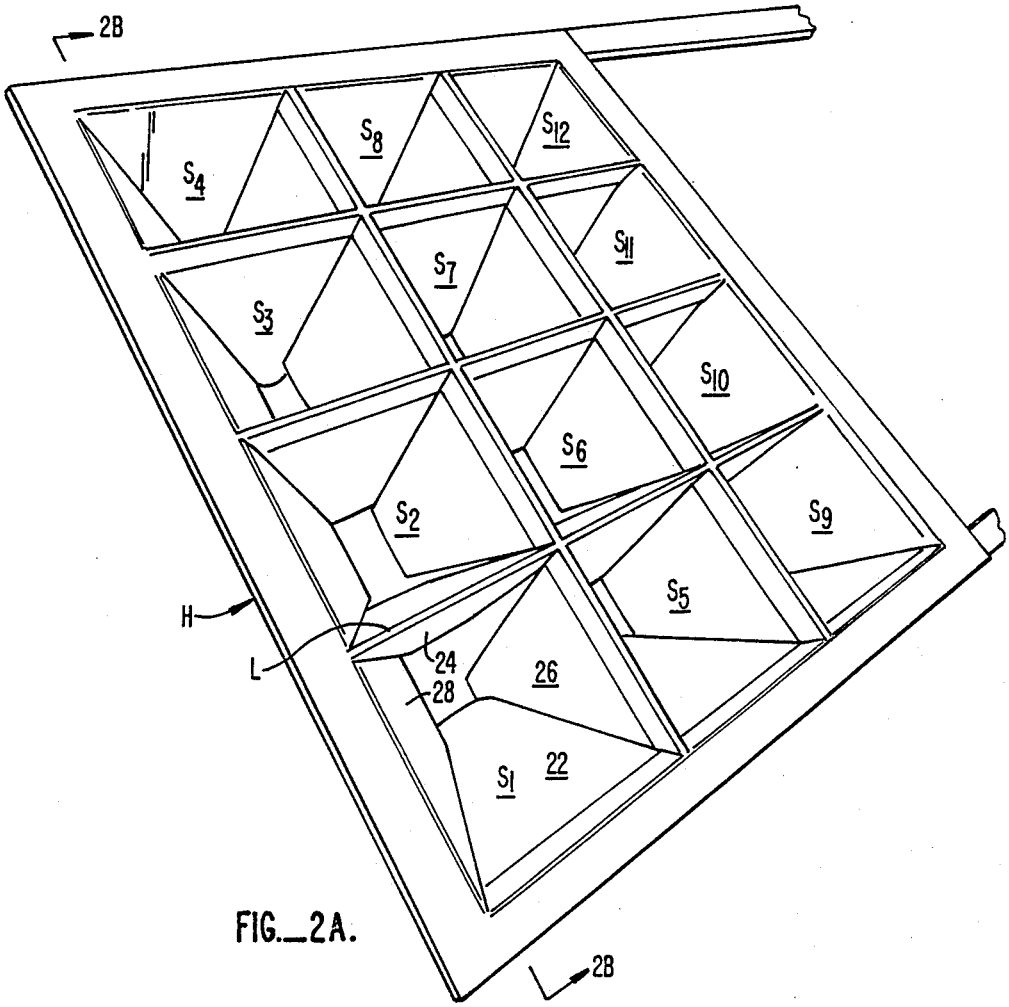
FIG. 2A is a perspective view of a lettuce head holding tray illustrating the tapered cells having narrowing stainless steel sides for enabling the lettuce to be temporarily held within the cells of the tray, transported to the packing apparatus and then unloaded through the bottom of the trays into awaiting cartons.
Figure 2B:
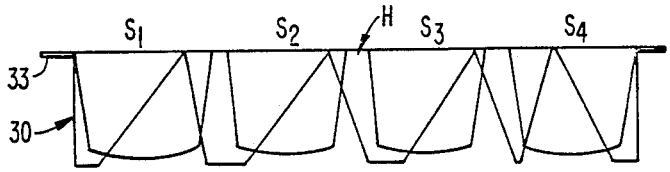
FIG. 2B is a side elevation of the lettuce head holding tray of FIG. 2A illustrating the side support apparatus for maintaining the tray cells elevated and permitting the trays to be conventionally transported on conveyors to and from the packing apparatus.

Referring to FIGS. 2A and 2B, the lettuce holding tray can be understood. The lettuce head holding tray includes lettuce head receiving cells S1–S12. The cells each have semirigid flexible sides. Using cell S1 as an example, sides 22, 24, 26 and 28 are all present. The cell sides are each generally triangular in shape. They fasten with their broad base at the top of the cell and depend downwardly from a lattice bar L. The cell sides are triangular. They decrease dimension as they extend downwardly.

These semirigid flexible sides can be made of stainless steel. Alternately, some plastics may also be suitable for the illustrated construction.

The cell sides 22, 24, 26 and 28 are resiliently mounted. This resilient mount is to and towards the top of each cell at the lattice. The cell sides are biased and bent inwardly to and towards the center of the cell. Thus, it can be seen each one of the cells S1–S12 defines a broad top and a narrow bottom.

The cells have two major functional purposes. First, and assuming that a head of lettuce is placed within each of the cells S, the spring bias of the sides is sufficient to maintain the head of lettuce within the cell in a resting state. The head cannot, of its own free weight, fall to and towards the ground.

Secondly, and during the packing operation, the heads of lettuce can be pushed through the bottom of the tray. That is to say, the lettuce holding tray H can have the head of lettuce at each of the cells S1–S12 pushed from the top of the tray through the bottom of the tray.

Referring to FIG. 2B, a side elevation of a typical tray H is shown. Specifically, the tray includes legs 30. These legs 30 depend downwardly onto a support surface such as the bottom of packing platform 20. The legs 30 extend upwardly to a lip 33, which lip extends around and protrudes outwardly from the side edges of each tray H. Lip 33 forms a surface on which the individual trays can be conveyed by a conventional chain conveyor 24 on the lower conveyor 14 and by the conventional chain conveyor 26 on the upper conveyor 16. (See FIG. 1.)

Thus it can be seen that legs 30 enable each tray H to rest on the packing station 20. At the same time edges 33 permit the individual holding tray to be conveyed between the picker in the field on one hand and the packing apparatus on the trailer on the other hand.

PACKING OF THE LETTUCE HEAD HOLDING TRAYS

Figure 3A:
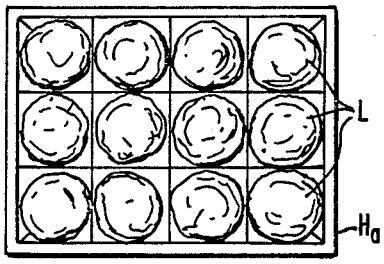
FIG. 3A is a plan view of the lettuce packed in a lettuce head holding tray in the stem down disposition for preferable packing of the lower level of a tray.
Figure 3B:
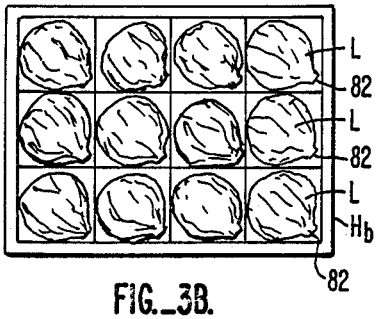
FIG. 3B is a plan view of the lettuce packed in the lettuce head holding tray in the item to the side disposition for preferable packing of the upper level of a carton.

Referring to FIGS. 3A and 3B, a plan view of a packed lettuce head holding tray filled with lettuce is shown. A first tray $H_A$ is shown in FIG. 3A. This tray is shown with the individual heads of lettuce L placed with their stems down. Tray $H_A$ is for loading the bottom of a carton of lettuce. Thus, the stems of the lettuce cannot be seen. Only the top and flowering part of the plant can be seen.

The reader will understand that the stems of lettuce are of particular danger insofar as abrading is concerned. Thus a worker W has loaded tray $H_A$ with the stems all faced downwardly.

Referring to FIG. 3B, tray $H_B$ is illustrated. In tray $H_B$ the heads of lettuce L are all illustrated with their respective stems 82 arrayed to the side. It will be seen that the stems 82 are angularly inclined with respect to each cell. Thus, the stems 82 will fall in the interstitial area between adjacent heads of lettuce. Assuming that the heads move simultaneously and as a unitary mass down into a carton, the stems of one head of lettuce L will not abrade the adjacent head of lettuce L.

Referring back to FIG. 1, it may be desirable to have two discrete packing mechanisms P on the trailer A. One packing mechanism P will be for packing the bottom layer of cartons, the remaining packing mechanism P will be for packing the top layers of cartons. In this case, worker W will orient lettuce on one side of the trailer A as shown in tray $H_A$ and on the opposite side of trailer A as shown in Tray $H_B$

PACKING APPARATUS

Having set forth the lettuce head holding tray itself, the packing apparatus of this invention can now be set forth and described. Specifically, referring to FIG. 4, the packing apparatus consists of a lower support frame F1 and an upwardly reciprocating frame F2. Frame F2 reciprocates over and away from boxes to be packed for required access to the apparatus.

Frame F2 supports 12 plungers C. These plungers C pass through the individual cells S of the lettuce head holding tray and cause the heads to be packed within the box B.

Box B is erected in the empty position and placed on a conveyor 18. Chain conveyors 28 convey the box B to the lowered elevator E. Elevator E elevates the box B to a position below the tray H. The open sidewalls of the box B conform to the tapered sides of the tray H.

The full trays H are conveyed into place onto conveyor 16 by conventional parallel chain conveyors 26. Conveyance occurs to and until the trays H are registered below the plungers C.

Figure 5A:
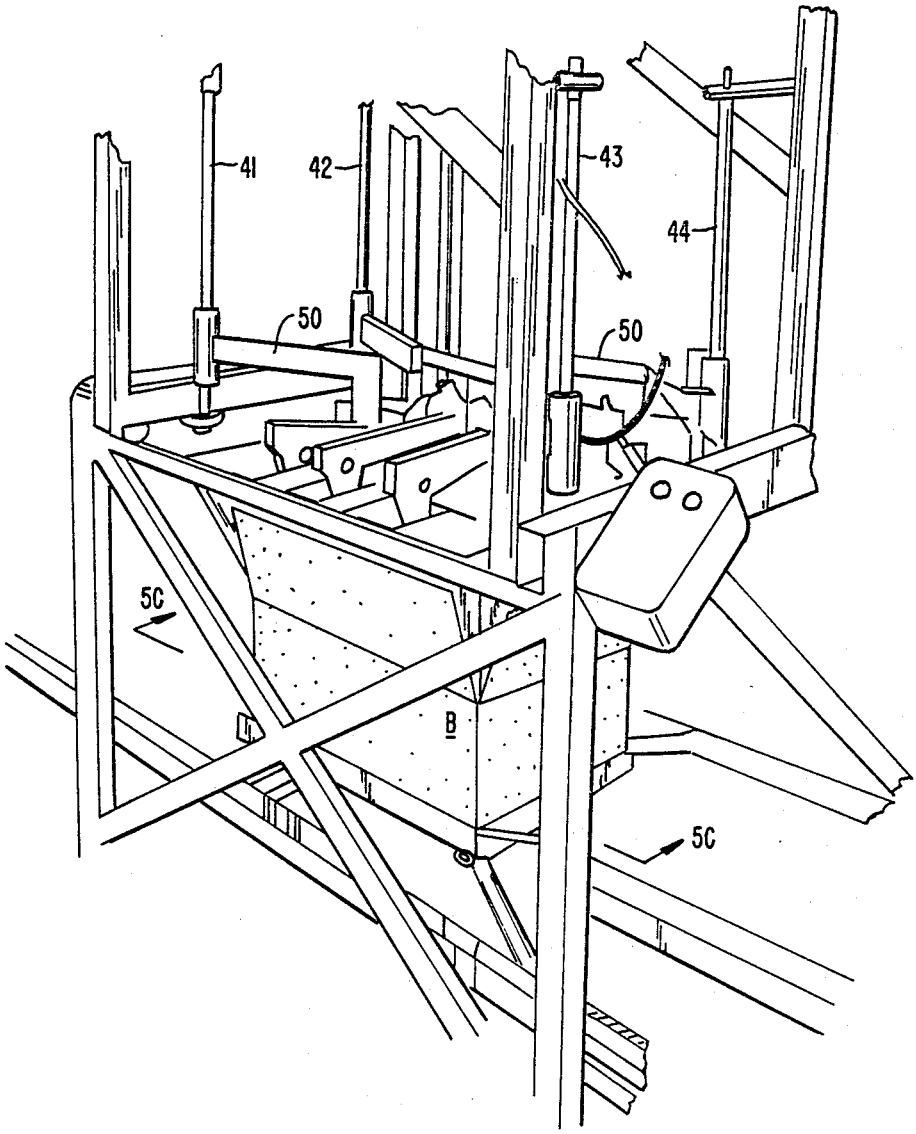
FIG. 5A is a perspective similar to FIG. 4 illustrating the packing apparatus making a full down stroke for the packing of one layer of lettuce into the underlying carton, the lettuce passing from the tray into a layer of the carton.

Each plunger C overlies a discrete cell. Referring to FIGS. 2A and 5C simultaneously it can be seen that plungers C1–C4 overlie cells S1–S4. Similarly and hidden from view, discrete plungers overlie cells S5–S8, and S9–S12. Since the operation of the illustrated plungers C1–C4 is typical, the plungers will not be described individually.

Figure 4:
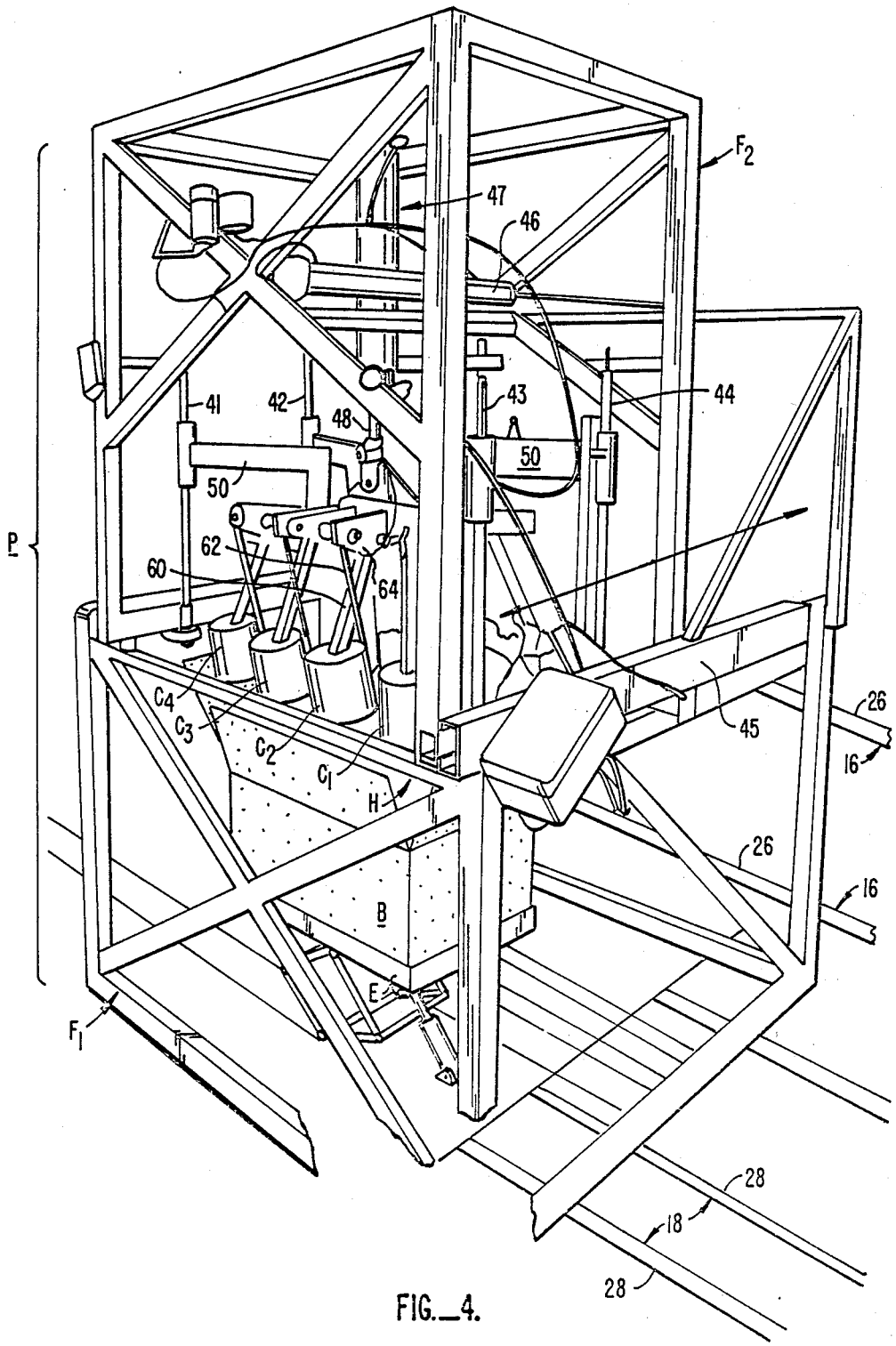
FIG. 4 is a perspective view of the packing apparatus of this invention showing a carton with an overlying lettuce head holding tray and an assembly of individual plungers, one plunger for each cell tray with the apparatus about to pack a layer of lettuce into the carton.

Cylinder 47 causes up and down movement of a support yoke 50. Support yoke 50 rides on bars 41, 42, 43, and 44. Thus, yoke 50 moves in a parallel relation towards and away from box B. In FIG. 4, yoke 50 is shown in the elevated position.

Cylinder 47 attaches to yoke 50 at a clevis 48. In such attachment, expansion and contraction of the cylinder causes up and down movement of the respective plungers C1–C4. These plungers in turn urge the individual heads of lettuce in the cells S into the awaiting box B below.

Each of the plungers C is held overlying a cell S by a linkage. This linkage permits the inward movement of the plunger upon the downward stroke of the yoke 50. Such movement can best be understood with respect to plunger C2.

Referring to plunger C2, it will be seen that it is mounted at arm 60. A tension coil spring 62 pulls the plunger C2 outwardly and away. It thus overlies the entry to cell S2.

Upon downward movement of the plunger C2, the plunger will move inwardly and towards a position overlying that spot in box B to which the head of lettuce L underlying the plunger is urged. This movement may be best understood by referring to the detail of FIG. 5B.

Figure 5B:
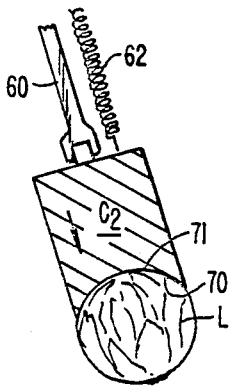
FIG. 5B is a perspective illustrating the contact of one plunger with one head of lettuce within a cell and illustrating only two sides of the cell with the concave portion of the plunger conforming to the general overall spherical shape of the lettuce head to prevent relative movement of the head during packing.
Figure 5C:
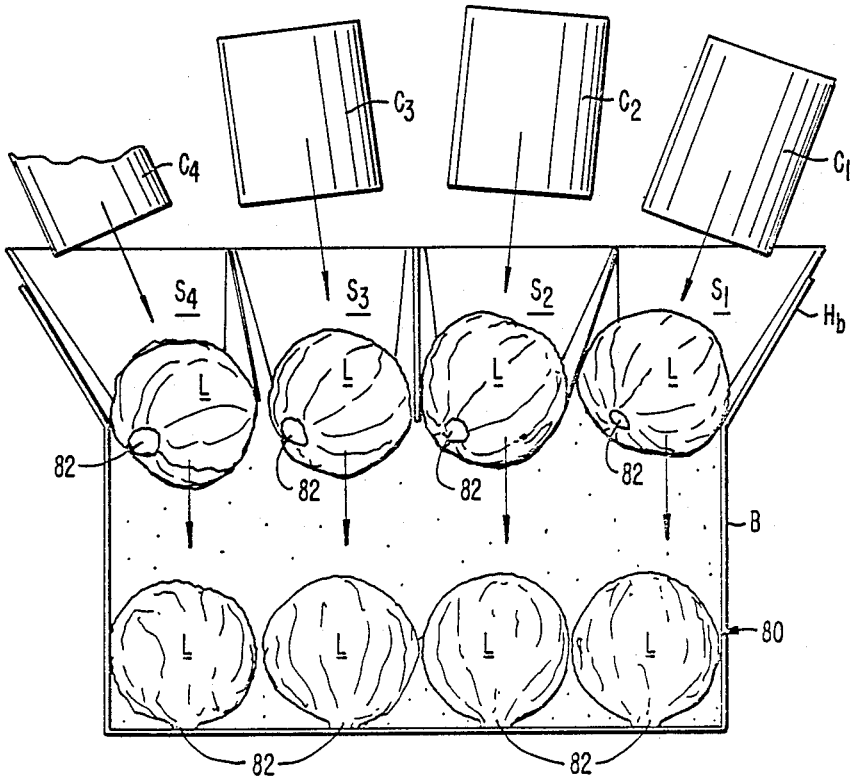
FIG. 5C is a side elevation of the view of FIG. 5A illustrating in particular the simultaneous movement of the heads of lettuce of a discrete layer as the heads of lettuce pass downwardly and into a tray.

Referring to FIG. 5B, it can be seen the plunger C2 has a concave surface 70. Concave surface 70 matches the general spherical configuration 71 of the outside of a head of lettuce L. At the same time, link 60 urged by coil spring 62, permits plunger C2 to move downwardly conforming to the cell sides.

Referring to FIG. 5C, box B is shown with its side removed. The elevator E is not shown. A first layer 8O of lettuce is shown all the way inserted. Stems 82 are shown downwardly disposed. Plungers

C1–C4, are shown in the process of placing the individual heads of lettuce L downwardly in and to the second layer of box B. Plunger C1 moves through cell S1 to place its head of lettuce at the same time plungers C2, C3, and C4 all move through their respective cells S2, S3 and S4 placing their heads of lettuce.

It will be noticed that the dimensions of tray H exceed the dimensions of box B. Consequently, the out plungers are linked in the manner illustrated in FIG. 5B to follow the heads of lettuce L to and towards their more compressed and packed disposition. The central plunger may be rigidly attached to yoke 50.

The lettuce head holding tray $H_B$ being unloaded has its respective heads of lettuce disposed with their stems 82 to the side. The concave portions of the individual plunger C1–C4 maintain the stems in this sideways position. Thus, the heads of lettuce L all pass out of the tray with their stems disposed to the side. When the heads come in contact one with another, there is no relative motion between the respective heads of lettuce. Because the stems 82 are formed to and towards the side, the stems fit in the interstitial area between heads. The stems are not disposed where they will abrade adjacent heads.

As has been previously pointed out, the packing of the second layer in a box B is the most difficult layer to pack. This is because not only can the stems 82 abrade adjacent heads of lettuce but the respective heads of lettuce must come in contact one with another. It has been found that the disclosed invention packs the respective heads with greater ease and more uniformity. Specifically, the heads of lettuce slide relative to the stainless steel sides of the tray $H_B$. They slide until the heads of lettuce contact each other.

After the heads of lettuce have contacted each other, they continue downwardly in box B. However, in this downward movement, there is no relative motion between the respective heads of lettuce L at their points of contact. The only relative motion occurs along the smooth sides of the carton. Thus, there is an even sliding and stuffing motion.

Referring to FIG. 5A, yoke 50 is shown with full excursion to the downward position. The individual heads of lettuce L have all been moved through their respective cells S into box B.

The reader will understand that the first packing stroke filling the bottom layer of box B with heads of lettuce L must be a long stroke. It will be further understood that the stroke packing the top of box B must be a short stroke. The apparatus for obtaining this short stroke is illustrated in FIGS. 6, 7A, and 7B.

Figure 6:
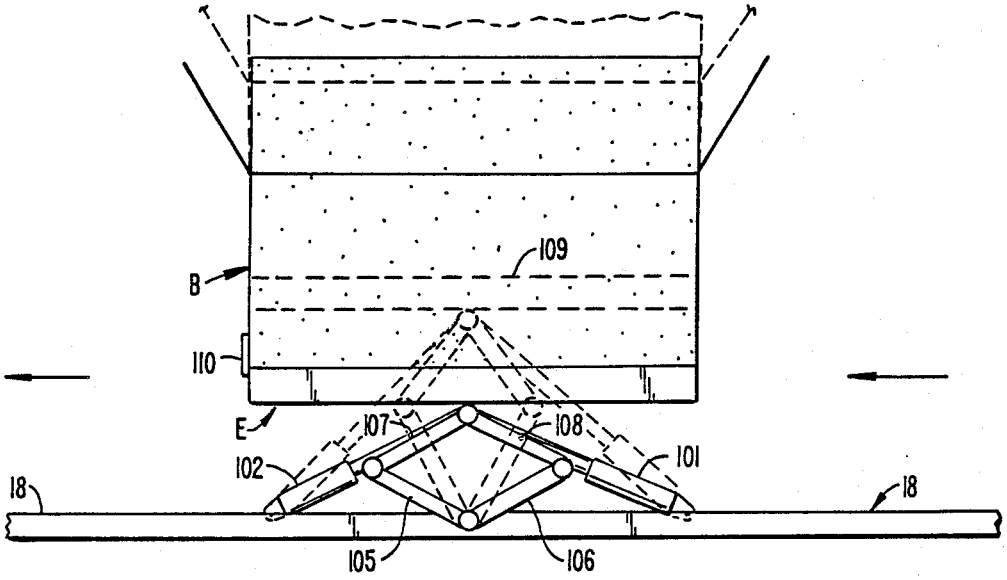
FIG. 6 is a detail of a carton elevator showing in broken lines the conforming movement of the elevator with respect to the stroke of the packing apparatus for permitting both lower and upper layers to be conveniently packed without undue damage to the heads of lettuce.
Figure 7A:
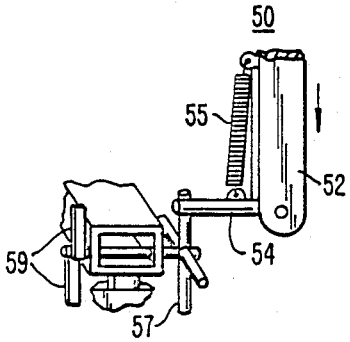
FIGS. 7A and 7B are details illustrating apparatus for shortening the stroke of the packing apparatus when packing the upper layer of lettuce in a two layer carton.
Figure 7B:
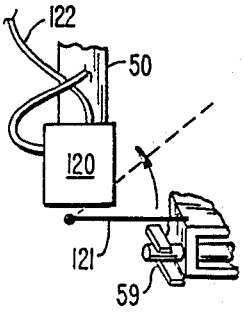

Referring to FIG. 6 a schematic detail of the box conveyor 18 and the elevator E is illustrated. Specifically, box 18 is conveyed in the empty state from left to right. The elevator E in the lower position interrupts the path of the box B at spring lug 110. Lug 110 is sufficiently strong to stop box B at the elevator E only when the box is in the empty position.

For raising of the box, air cylinders 101 and 102 expand square linkage 105, 106, 107, and 108. The linkage effectively elevates the elevator E with the box B on it. Such elevation occurs immediately under a tray H and the plunger C (the tray H and plunger C being omitted from the view of FIG. 6).

Typically, elevation of the elevator E will occur to a level 1O9. It is at level 109 that the first and initial layer of heads of lettuce are packed from a tray $H_A$.

The reader will remember that a second and shorter stroke is required when the heads of lettuce from $H_B$ are loaded. This being the case, cylinders 101 and 102 act as air springs. Elevator E yields downwardly as the uppermost layer of lettuce L is packed within box B.

It is also necessary to cause the stroke of piston 47 acting on clevis 48 (see FIG. 1) to be shortened for the packing of the top layer. This is easily accomplished by the mechanism set forth in FIGS. 7A and 7B.

Simply stated, frame 50 has attached a downwardly extending arm 52. Arm 52 has a link 54 biased to the upward position by a coil spring 55. In a downward movement link 54 rotates a spoke wheel 57. Spoke wheel 57 has four spokes at 90° intervals. This spoke wheel 57 rotates 90° with each downward stroke.

Spoke wheel 57 is connected by a shaft to paired paddles 59. Paddles 59 rotate so that in a first stroke of lever 50 the paddles are vertically disposed and in a second stroke of bar 52 the paddles are horizontally disposed. Thus, the paddles are only disposed in the horizontal disposition every second stroke. It is this horizontal disposition of paddle 59 that is utilized to shorten the stroke for the packing of the top layer of lettuce in box B.

In the horizontal disposition and as shown in FIG. 7B, paddles 59 serve to also foreshorten the stroke. Specifically, a valve mechanism 120 is opened by a valve lever 121. On every other downward stroke, valve lever 121 strikes one of the paddles 59. Valve mechanism 120 is positioned on yoke 50 so that air is bleed to atmosphere on a line 122 actuating pneumatic cylinder 47. This bleeding to atmosphere foreshortens the stroke and prevents the jamming of the overlying layer of lettuce L onto the underlying layer of lettuce L.

The reader will understand that there has been disclosed a simple lettuce packing mechanism. It utilizes the simultaneous movement of an entire layer of lettuce into a box. The lettuce slides along the sidewalls of the lettuce head holding trays in which it is contained as well as the sidewalls of the box into which it is going to be received. At the same time, there is no relative and abrading movement between the individual heads of lettuce. There results a pack of lettuce which not only has less damage at the points where the individual heads touch each other but which can be readily observed to be a finer freer pack than that done by hand.

What is claimed is:

1. A lettuce head holding tray having a plurality of cells for receiving lettuce from a picker in a field, for transporting the lettuce from the picker to the packing station, and for permitting the packing of lettuce within a lettuce box, said trays for receiving rows and columns of lettuce at the top, holding said rows and columns of lettuce in side-by-side relation during transporting and permitting said rows and columns of lettuce to be removed through the bottom of said tray for packing to said lettuce box, said tray comprising:

a lattice defining the exterior perimeter of the cells for holding heads of lettuce in rows and columns, said lattice including, first lattice members extending parallel to said columns on either side of said cells, and second lattice members for extending parallel to said rows on either side of said rows, said first and second lattice members joined together to form said lattice;

cell side members, each said cell side member extending at least a portion of the width of said cell from one of said lattice members, said cell side members attached to said lattice member at the upper end and depending downwardly and inwardly of said cell from said upper end to said lower end;

means for elastically mounting said cell side members to said lattice member to permit elastic movement of said cell side members sides away from the center of said cell whereby heads of lettuce supported in said tray may be forced out the bottom of said cells;

said cell side members of each said cell together defining a narrowing dimension to said cell, said dimension narrowing from the top of said cell to and towards the bottom of said cell whereby a head of lettuce freely received through said lattice at the top of said cell comes into supporting contact with the cell side members upon downward movement with respect to said cell.

2. The invention of claim 1 wherein the top of said lattice forms a dimension exceeding the dimension of said box and the bottom of said tray conforms to the dimension of said box.

3. The invention of claim 1 and wherein said cell side members are formed of semirigid, flexible material and said semirigid, flexible material constitutes said means for elastically mounting said cell side members to said lattice from said lattice members to form said sides of said cell.

4. A packing apparatus for packing a layer of produce in a box, said layer occupying a full horizontal dimension of said box extending at least a partial height of said box comprising in combination: a lettuce head holding tray for receiving lettuce from a picker in a field, said tray being independently transportable including a lattice defining the exterior perimeter of rows and columns of cells within said tray for holding heads of lettuce in rows and columns for occupying a full horizontal dimension of said box;

cell side members, each cell side member extending at least a portion of the width of said cell from one of said lattice members, said cell side members attached to said lattice member at the upper end and depending downwardly and inwardly of said cell from said upper end to said lower end;

means for elastically mounting said cell side member to said lattice member to permit elastic movement of said sides away from the center of said cell whereby heads of lettuce supported in said tray may be forced out the bottom of said cell;

said cell side members of each said cell together defining a narrowing dimension to said cell, said dimension narrowing from the top of said cell to and towards the bottom of said cell whereby a head of lettuce freely received through the lattice at the top of said cell comes into supporting contact with said cell side members upon downward movement with respect to said cell;

a picking station having means supporting said lettuce holding tray;

a packing station;

means for conveying said lettuce holding tray from said picking station to said packing station;

a packer at said packing station for packing heads of lettuce supported in said tray down through the bottom of said tray and into a carton below said tray, said packer comprising in combination;

means for registering said tray to said packer;

a mount for movement towards and away from said tray overlying said tray; a plurality of plungers, each said plunger individually suspended from said mount and entering into said tray at one of said cells; said mount moving said plungers from a first position overlying said cells to a second position interior and through said cells whereby said heads of lettuce within said cell move simultaneously from said cell and out the bottom of said cell for placement into said underlying carton.

5. The invention of claim 4 and wherein said cell side walls are formed of semirigid, flexible material and said semirigid, flexible material defines said means for elastically mounting said cell sides to said lattice.

6. The invention of claim 4 and including a conveyor for conveying cartons to and from a position of registration under said lettuce head holding tray.

7. The invention of claim 4 and including a conveyor for transporting lettuce head holding trays to and from a picking station to said packing apparatus.

* * * * *